US005398174A

United States Patent [19]

Fast

[11] Patent Number: 5,398,174

[45] Date of Patent: Mar. 14, 1995

[54] POST FOR MARKING ROAD VERGES

[75] Inventor: Peder Fast, Kullavik, Sweden

[73] Assignee: Ultralux AB, Göteborg, Sweden

[21] Appl. No.: 39,088

[22] PCT Filed: Oct. 25, 1991

[86] PCT No.: PCT/SE91/00720

§ 371 Date: Apr. 7, 1993

§ 102(e) Date: Apr. 7, 1993

[87] PCT Pub. No.: WO92/08219

PCT Pub. Date: May 14, 1992

[30] Foreign Application Priority Data

Oct. 26, 1990 [SE] Sweden ..... 9003427

[51] Int. Cl.[6] ..... F23B 9/00; G09F 13/20

[52] U.S. Cl. ..... 362/84; 362/431; 362/812; 116/63 R

[58] Field of Search ..... 362/26, 31, 84, 293, 362/431, 812; 116/63 R; 404/9, 10, 14; 40/558, 542, 543, 546

[56] References Cited

U.S. PATENT DOCUMENTS

| | | | |
|---|---|---|---|
| 297,741 | 4/1884 | Babcock | 40/542 |
| 2,028,241 | 1/1936 | Paul | 362/84 |
| 2,095,609 | 10/1937 | Long | 362/431 |
| 2,358,867 | 9/1944 | Madan | 362/84 |
| 2,480,584 | 8/1949 | Kohlhauer et al. | 40/542 |
| 2,905,863 | 9/1959 | Martin et al. | 362/84 |
| 3,153,773 | 10/1964 | Wood | 362/84 |
| 3,502,007 | 3/1970 | Anderson | 116/63 R |
| 4,253,085 | 2/1981 | Hidler et al. | 40/558 |
| 4,546,417 | 10/1985 | Watts | 362/431 |
| 5,021,931 | 6/1991 | Matsui et al. | 362/84 |

FOREIGN PATENT DOCUMENTS

| | | | |
|---|---|---|---|
| 419229 | 3/1991 | European Pat. Off. | 40/542 |
| 844194 | 7/1939 | France . | |
| 862277 | 3/1941 | France . | |
| 526992 | 9/1927 | Germany . | |
| 458594 | 4/1989 | Sweden . | |

OTHER PUBLICATIONS

Continental Lithograph Corporation, Jun. 11, 1940.

*Primary Examiner*—Ira S. Lazarus
*Assistant Examiner*—Y. Quach
*Attorney, Agent, or Firm*—Nies, Kurz, Bergert & Tamburro; Philip E. Kurz

[57] ABSTRACT

A verge post having a plurality of flat vertical side faces and side edges for marking road verges or the boundaries of traffic lanes. The post is constructed with material which will fluoresce when illuminated with ultraviolet light, and to transmit visible light from the side faces and edges in two or more directions when illuminated with ultraviolet light from one direction. Different parts of the post can be made so they will fluoresce with different colors when illuminated with ultraviolet light.

8 Claims, 1 Drawing Sheet

POST FOR MARKING ROAD VERGES

The present invention relates to a post for marking the verges of roads or traffic lanes.

Verge posts are used to enhance optical guidance along primarily non-illuminated traffic routes. Reflectors are placed on the posts, so that they can be seen in the stray light from dipped headlamps. In Sweden, these reflectors are positioned slightly higher from the road surface than the reflectors in the remainder of Europe, since the reflectors are then less likely to become covered with dirt. The reflectors are placed at a height of 750 mm above the road surface, and consequently only stray light will impinge on the reflectors when using dipped headlamps.

Reflectors which are turned to face towards bordering woodlands, so-called wildlife mirrors, are said to have a certain deterring effect on wildlife.

In Sweden, two round reflectors are used on the left side of the road and one rectangular reflector on the right side of the road, when the road is intended for two-way traffic. The reflectors are coloured white except at bus stops, road crossings, etc. Round reflectors cannot be distinguished from rectangular reflectors at short distances, and the public is unable to discern the difference between these reflectors. A number of countries position reflectors of mutually different colours on the right and the left side of a road. These reflectors cannot be distinguished one from the other by people who have defective colour vision.

It is difficult to judge the distance to a reflector, since the surface is small and the intensity of the light reflected by the reflector decreases with the square of the distance, whereas the light reflected from normal objects decreases with the distance raised to the power of four. The difficulties of judging distance cause verge posts to become highly confusing and tests have shown that they can also be directly misleading, particularly those posts which are positioned along curved and undulating roads.

The present invention provides a totally novel verge post which eliminates the drawbacks associated with known verge posts.

Thus, the-present invention relates to a verge post for marking road verges or the boundaries of traffic lanes, and is characterized in that the verge post is constructed to fluoresce when illuminated with ultraviolet light; and in that the post is constructed so that when illuminated with ultraviolet light from one direction, the post will transmit visible light in two or more directions.

The invention will now be described in more detail with reference to exemplifying embodiments thereof and also with reference to the accompanying drawing, in which FIG. 1 illustrates a first side of an inventive post;

Figure 1:
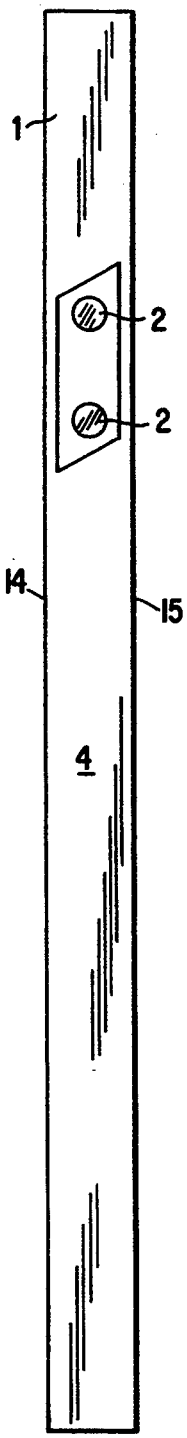
Figure 2:
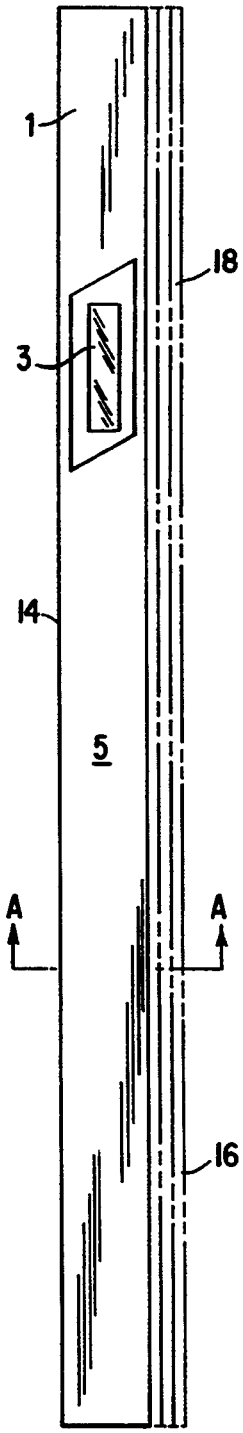
FIG. 2 illustrates a second side of an inventive post, the phantom lines showing an alternative additional strip as illustrated in the embodiments of FIGS. 3 and 4.

FIGS. 1 and 2 shows a verge post 1 from two different directions, said poet being intended to mark the verges of a road or the boundaries of traffic lanes. FIG. 1 illustrates a post which is intended to be mounted on the left side of the road, and FIG. 2 illustrates a post intended to be mounted on the right side of the road, as seen in the forward direction of the traffic. The posts are provided with visible light reflectors 2, 3, which are of mutually different configurations on respective sides 4, 5 of the posts.

According to the invention, the post is intended to fluoresce when illuminated with ultraviolet light, and is so constructed that when illuminated with ultraviolet light from one direction, the post will transmit visible light in two or more directions.

In recent years, strenuous efforts have been made to enable automotive vehicles, primarily cars, to be fitted with headlamps which emit ultraviolet light as a complement to conventional visible light. This technique is discussed, for instance, in the Swedish Patent Specification No. 8704118-2.

Figure 3:
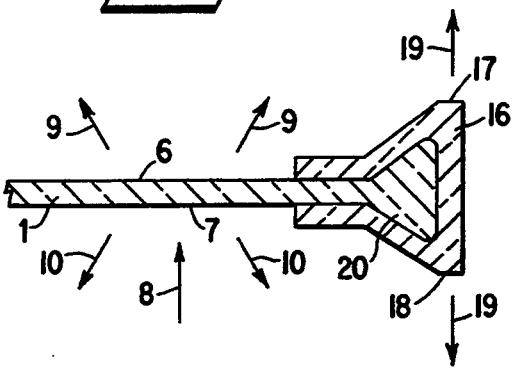
FIG. 3 is a cross-sectional view of part of the post shown in FIG. 2 according to a first embodiment, the view being taken on the line A—A in said Figure.

According to a first embodiment of the present invention, the verge post is constructed from a plastic material which is transparent to ultraviolet light. In this case, two or more sides of the post 1 are coated with a fluorescent material 6, 7, which is pervious to ultraviolet light. This embodiment is illustrated in FIG. 3. Tne arrow 8 illustrates incident ultraviolet light and the arrows 9, 10 exemplify the visible light emitted as a result of the fluorescence. Because the verge post is constructed from material which is transparent to ultraviolet light, the incident ultraviolet light 8 will pass through the post to the layer 6.

The fluorescent material used may be any kind of commercially available material. For example, a commercially available fluorescent paint can be used.

According to a second, alternative embodiment, the verge post is constructed from a plastic material which is transparent to ultraviolet light, this material having been treated so that the material will fluoresce when illuminated with ultraviolet light. According to this embodiment, a fluorescent pigment may be admixed with the plastic material. Such pigments are known and commercially available. It is also possible to use a fibreglass material and to dope the material during its manufacture with a given quantity of a substance which causes the glass fibres to fluoresce in its presence. This technique of obtaining fluorescence is also known and will not therefore be discussed in detail here.

According to one preferred embodiment of the invention, the post is treated on each of different sides thereof with a different material which fluoresce in different colours, preferably two opposing and substantially parallel flat sides 4, 5 of the post.

Figure 4:
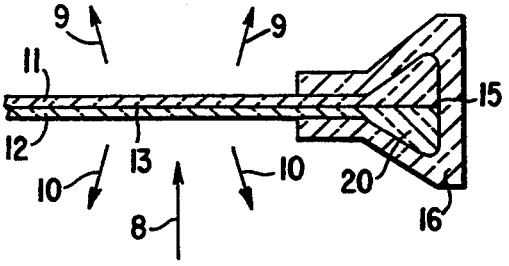
FIG. 4 is a cross-sectional view of part of a second embodiment taken on the line A—A in FIG. 2.

According to an alternative embodiment, illustrated in FIG. 4, the verge post comprises two parts 11, 12, preferably two parallel, plate-like parts, wherein the two parts 11, 12 are treated in different ways so that each will fluoresce in a different color. In this case the outwardly facing surface of respective part 11, 12 may be coated with a fluorescing colour or the parts 11, 12 may consist of plastic plates where for example different pigments have been admixed into the respective plates in order to achieve that the material of the plates fluoresce in different colours.

In the case where the verge poet consists of two plate-like parts 11, 12, a layer 13 is placed between the two plate-like parts 11, 12 in accordance with one preferred embodiment of the invention, this layer 13 consisting of a material which is transparent to ultraviolet light but impervious to visible light. A foil of so-called Wood's glass is an example of such a layer. The resultant effect of this arrangement is that the visible light transmitted from one side 4; 5 of the post will not be transmitted in the other direction, i.e. through the other side 4; 5 of the post subsequent to having been According to one preferred embodiment of the invention, the post is pigmented such that when illuminated with visible light, it will have the same, or substantially the same colour as that when illuminated with ultraviolet light.

The inventive verge post is preferably provided with the aforesaid reflectors 2, 3.

According to another preferred embodiment, the verge post 1 is constructed from panels and is fitted along one side edge 14 and/or the other side edge 15 with a substantially U-shaped edge strip 16 made of a plastic material which is transparent to ultraviolet light and which will fluoresce when illuminated with ultraviolet light, see FIGS. 3 and 4. The verge post of this embodiment is configured with a thickening 20 along those edges where a strip 16 is located, this thickening filling the U-shaped strip 16. The strip 16 is indicated in phantom lines in FIG. 2.

A strip of this kind functions as a light guide and will guide light from the panel-like part of the post out through the edges 17, 18 of the strip, as illustrated by the arrows 19.

In order to provide verge posts which fluoresce in white light, several different complementary fluorescing substances are used, so that the combined light transmitted by the fluorescing substances will be observed as white light.

The inventive verge post provides a number of advantages over known verge posts.

Firstly, the function of the inventive post is less likely to be impaired by dirt, since the scattering of light does not have the same effect as for reflectors.

Furthermore, such criteria as positioning and height are not equally as significant as for reflectures. The top part of the poet also has a useful function.

The large surface area of the post as compared with the surface of the reflectors enables the poet to be discerned more readily at distance. The surface shall be greater than approximately 50 $cm^2$ in order for the distance to be judged satisfactory. Fluorescence provides a powerful light within a given wavelength range, as opposed to conventional paints. This enables the posts to be given different colours which can readily be distinguished and discerned at long distances in the dark.

Many people suffering from defective colour vision are able to distinguish between different colours of an intensive fluorescent light.

As will be evident from the aforegoing, fluorescent verge posts can be constructed to emit light in several directions and are not only retroreflective. This means that the light from mutually meeting vehicles will assist in the fluorescence of verge posts, enabling the posts to be noticed from long distances.

As mentioned before, the posts can be constructed so as to have different colours on the right and the left side of the post. This greatly reduces the risk of confusion and misinterpretation.

Further, the poet transmits light in a direction away from the road, which my possibly have a deterring effect on roadside wildlife.

Although the invention has been described with reference to a number of embodiments thereof, it will be understood that the configuration of the post, its appearance and its construction can be varied and modified within the scope of the present invention.

The invention shall not therefore be considered restricted to the aforedescribed exemplifying embodiments, since modifications can be made within the scope of the following claims.

I claim:

1. A verge post for marking road verges and boundaries of traffic lanes, wherein the post has a plurality of flat vertical side faces and side edges and comprises material which will fluoresce when illuminated with ultraviolet light, and when said post is illuminated with ultraviolet light from one direction, said side faces and side edges providing, transmission of visible light from the post, due to fluorescing of said material, in at least two directions including said one direction; said post being made from panels with said flat faces and said side edges; a substantially U-shaped edge strip is fitted on and along at least one side edge of the post; and said substantially U-shaped edge strip is made from a plastic material which is transparent to ultraviolet light and which will fluoresce when illuminated with ultraviolet light.

2. A verge post for marking road verges and boundaries of traffic lanes, wherein the post has a plurality of flat vertical side faces and side edges and comprises material which will fluoresce when illuminated with ultraviolet light, and when said post is illuminated with ultraviolet light from one direction, said side faces and side edges providing, transmission of visible light from the post, due to fluorescing of said material, in at least two opposite directions including said one direction; said post is made from a plastic material, which is transparent to ultraviolet light; and wherein at least two of the side faces and side edges are coated with said material which will fluoresce and is permeable to ultraviolet light; opposite faces and edges of the post being treated with different fluorescent materials which provide fluorescing light of different colors and in said at least two opposite directions.

3. A verge post as defined in claim 2, wherein said faces of the post include at least two side faces which are opposing, parallel and substantially flat side faces on said post.

4. A verge post according to claim 2, characterized in that the plastic material from which said post is made is treated so that it will fluoresce when illuminated with ultraviolet light.

5. A verge post according to claim 2, wherein said side faces comprise at least two parallel plate-like parts, the material from which the two plate-like parts are made being treated differently so as to respectively fluoresce with different visible colored light.

6. A verge post according to claim 2, wherein said post is pigmented so that when illuminated with visible light, it will have substantially the same color as that when illuminated with ultraviolet light.

7. A verge post for marking road verges and boundaries of traffic lanes, wherein the post has a plurality of flat vertical side faces and side edges and comprises material which will fluoresce when illuminated with ultraviolet light, and when said post is illuminated with ultraviolet light from one direction, said side faces and side edges providing, transmission of visible light from the post, due to fluorescing of said material, in at least two directions including said one direction; said material which will fluoresce when illuminated with ultraviolet light including several different complementary fluorescent substances which will provide a combined light emitted with fluorescence that will be observed as white light.

8. A verge post for marking road verges and boundaries of traffic lanes, wherein the post has a plurality of flat vertical side faces and side edges and comprises material which will fluoresce when illuminated with ultraviolet light, and when said post is illuminated with ultraviolet light from one direction, said side faces and side edges providing, transmission of visible light from the post, due to fluorescing of said material, in at least two opposite directions including said one direction; said post is made from a plastic material, which is transparent to ultraviolet light; and wherein at least two of the side faces and side edges include said material which will fluoresce and is permeable to ultraviolet light; said post comprising at least two parallel plate-like parts and a layer of material which is transparent to ultraviolet light, but impervious to visible light, different ones of said at least two plate-like parts of the post being treated with different fluorescent materials so that the parts respectively fluoresce with different visible colored light in different directions, and said layer of material is disposed between the at least two plate-like parts.

* * * * *